US007314379B2

(12) United States Patent
Chen et al.

(10) Patent No.: US 7,314,379 B2
(45) Date of Patent: Jan. 1, 2008

(54) ADAPTER DEVICE WITH RESILIENT CONDUCTIVE MEANS

(75) Inventors: Chao-Jung Chen, Taipei (TW); Chin-Yun Yu, Taipei (TW); Chien-Chung Chiang, Taipei (TW); Ta-Chun Lin, Taipei (TW)

(73) Assignee: Avermedia Technologies Inc., Chung Ho, Taipei Hsien (TW)

( * ) Notice: Subject to any disclaimer, the term of this patent is extended or adjusted under 35 U.S.C. 154(b) by 0 days.

(21) Appl. No.: 11/377,868

(22) Filed: Mar. 16, 2006

(65) Prior Publication Data

US 2007/0141870 A1 Jun. 21, 2007

(30) Foreign Application Priority Data

Dec. 16, 2005 (TW) ..... 94144839 A

(51) Int. Cl.
*H01R 13/648* (2006.01)

(52) U.S. Cl. ..... 439/95; 439/92; 439/562; 439/610; 439/108; 361/818

(58) Field of Classification Search ..... 439/92, 439/95, 108, 610, 562; 361/818
See application file for complete search history.

(56) References Cited

U.S. PATENT DOCUMENTS 5,655,932 A 8/1997 Breitschaft et al.
5,695,362 A 12/1997 Hillbish et al.
6,010,365 A 1/2000 Wu et al.
6,168,448 B1 1/2001 Chang
6,200,161 B1 3/2001 McClinton et al.
6,312,267 B1 * 11/2001 Wang ..... 439/92
6,459,517 B1 * 10/2002 Duncan et al. ..... 398/135
6,508,653 B2 * 1/2003 Malone et al. ..... 439/92
6,991,494 B1 1/2006 Spink, Jr.

FOREIGN PATENT DOCUMENTS

EP 0524426 8/1997
TW 419146 Y 1/2001

* cited by examiner

*Primary Examiner*—Truc Nguyen
(74) *Attorney, Agent, or Firm*—Kirton & McConkie; Evan R. Witt

(57) ABSTRACT

A computer adapter such as a TV card includes a circuit board to be inserted in an expansion slot of the computer system; a signal transmission connector socket having a first end secured to the circuit board and a second end to be coupled to an external signal transmission connector; a securing plate securable to the computer system and the circuit board, and having a through hole for exposing the second end of the signal transmission connector socket; and an elastic metallic conductive member mounted between the signal transmission connector socket and the securing plate. The elastic metallic conductive member has a crooked cross-section in a certain direction so as to be elastically stretchable in the certain direction, thereby in contact with both of the signal transmission connector socket and the securing plate to accomplish electric connection.

11 Claims, 6 Drawing Sheets

ADAPTER DEVICE WITH RESILIENT CONDUCTIVE MEANS

FIELD OF THE INVENTION

The present invention relates to an adapter device for use in a computer system, for example, a TV card, and more particularly to an adapter device with resilient conductive means for well grounding certain elements of the adapter device.

BACKGROUND OF THE INVENTION

Please refer to FIG. 1, which is a schematic diagram showing a typical TV card 1. There are principally two sets of I/O terminals, wherein the first one is a TV signal transmission connector 110 of a channel tuner 11, i.e. so-called RF connector, and the second one is an AV terminal socket set 12 that typically consists of three AV terminals for left/right audio and video connections, i.e. so-called RCA connector.

For complying with the requirements of three major environmental stipulations in European, i.e. WEEE, RoHS and EUP, an adapter manufacturers need to electrically connecting the TV signal transmission connector 110 and the AV terminal socket set 12 disposed on a circuit board to a securing plate 13 coupled to a computer casing (not shown). In this conductively grounding way, electrostatic discharge (ESD) protection can be achieved and noise interference can be reduced from the signal transmitted through the TV signal transmission connector 110 and the AV terminal socket set 12. So far, there have been only copper rings, aluminum foils, conductive foams and spot welding material used as the conducting, grounding and noise-eliminating means. Among the means, copper ring washers 14 are the most popular, which are inserted between the TV signal I/O connector 110/AV terminal socket set 12 and the securing plate 13. As the clearance between the TV signal transmission connector 110/AV terminal socket set 12 and the securing plate 13 may vary with products, copper ring washers with various thicknesses need be prepared by the manufacturer to fit possibly various clearances between the securing plate 13 and the connectors 110 and 12. The stock material would increase manufacturer's cost. Moreover, conventionally used copper ring washers containing high cadmium (Cd) contents may fail the RoHS stipulations and become environmentally unacceptable in European Union.

The electric connection between the TV signal transmission connector 110 and the AV terminal socket set 12, if accomplished by aluminum foil seal or conductive foam seal (not shown), would uglify the product and thus lower the value of the product. In addition, because the aluminum foil or conductive foam is applied by adhesion, the limitation in space would deteriorate the adhesion and thus result in stripping or damage of the aluminum foil or conductive foam. Moreover, the grounding feature is highly affected by the quality of the adhesive, so the anti-noise performance is hard to be controlled.

On the other hand, though the electric connection conducted by spot welding (not shown) is a better solution than aluminum foil seal in good contact between the TV signal transmission connector 110 and the AV terminal socket set 12, it still result in low-valued appearance of the product. In addition, the manufacturing cost will be adversely affected due to the extended laboring.

SUMMARY OF THE INVENTION

Therefore, the present invention provides resilient conductive means between the connectors/sockets and the securing plate, which achieves the purposes of high assembling allowance, good conductive effect as well as additive value in appearance at the same time.

The present invention relates to an adapter for use in a computer system, which comprises a circuit board to be inserted in an expansion slot of the computer system; a signal transmission connector socket having a first end secured to the circuit board and a second end to be coupled to an external signal transmission connector; a securing plate securable to the computer system and the circuit board, and having a through hole for exposing the second end of the signal transmission connector socket; and an elastic metallic conductive member mounted between the signal transmission connector socket and the securing plate, and having a crooked cross-section in a certain direction so as to be elastically stretchable in the certain direction, thereby in contact with the signal transmission connector socket and the securing plate to accomplish electric connection.

In an embodiment, the circuit board may be disposed thereon pins to be inserted in the expansion slot of the computer system.

In an embodiment, the signal transmission connector socket can be a TV signal transmission connector that is disposed on a channel tuner and shares a metallic housing with the channel tuner.

In an embodiment, the elastic metallic conductive member may sustain against the metallic housing and the securing plate to accomplish electric connection.

In an embodiment, the signal transmission connector socket can be an AV terminal socket.

In an embodiment, one end of the elastic metallic conductive member may be coupled to the AV terminal socket with claw hooks, and another end of the elastic metallic conductive member may sustain against the securing plate to accomplish electric connection.

In an embodiment, the adapter may further comprise another two AV terminal sockets. The elastic metallic conductive member includes three through holes for receiving the AV terminal sockets, and the though holes have a claw-hook structure to couple to the AV terminal sockets.

In an embodiment, the elastic metallic conductive member may have a crooked cross section shaped "U", "S" or "M".

Another aspect of the present invention relates to an elastic securing device for use with an adapter and a computer system. The adapter comprises a circuit board to be inserted in the computer system and a signal transmission connector socket coupled to the circuit board. The elastic securing device comprises a securing plate to be coupled to the computer system and the circuit board, having a through hole for partially exposing the signal transmission connector socket; and an elastic metallic conductive member mounted between the signal transmission connector socket and the securing plate, and having a crooked cross-section in a certain direction so as to be elastically stretchable in the certain direction, thereby sustaining the signal transmission connector socket and the securing plate to accomplish electric connection.

A further aspect of the present invention relates to a method for assembling an adapter, which comprises steps of: providing a circuit board where a signal transmission connector socket is disposed; providing a securing plate where a through hole is arranged for partially exposing the signal transmission connector socket; and mounting an elastic metallic conductive member between the signal transmission connector socket and the securing plate and then securing the circuit board to the securing plate, wherein the elastic metallic conductive member has a crooked cross-section in a certain direction so as to be elastically stretchable in the certain direction, thereby sustaining the signal transmission connector socket and the securing plate to accomplish electric connection.

BRIEF DESCRIPTION OF THE DRAWINGS

The present invention may best be understood through the following description with reference to the accompanying drawings, in FIG. 1 is a schematic diagram showing a conventional TV card.

DETAILED DESCRIPTION OF THE PREFERRED EMBODIMENT

Figure 1:
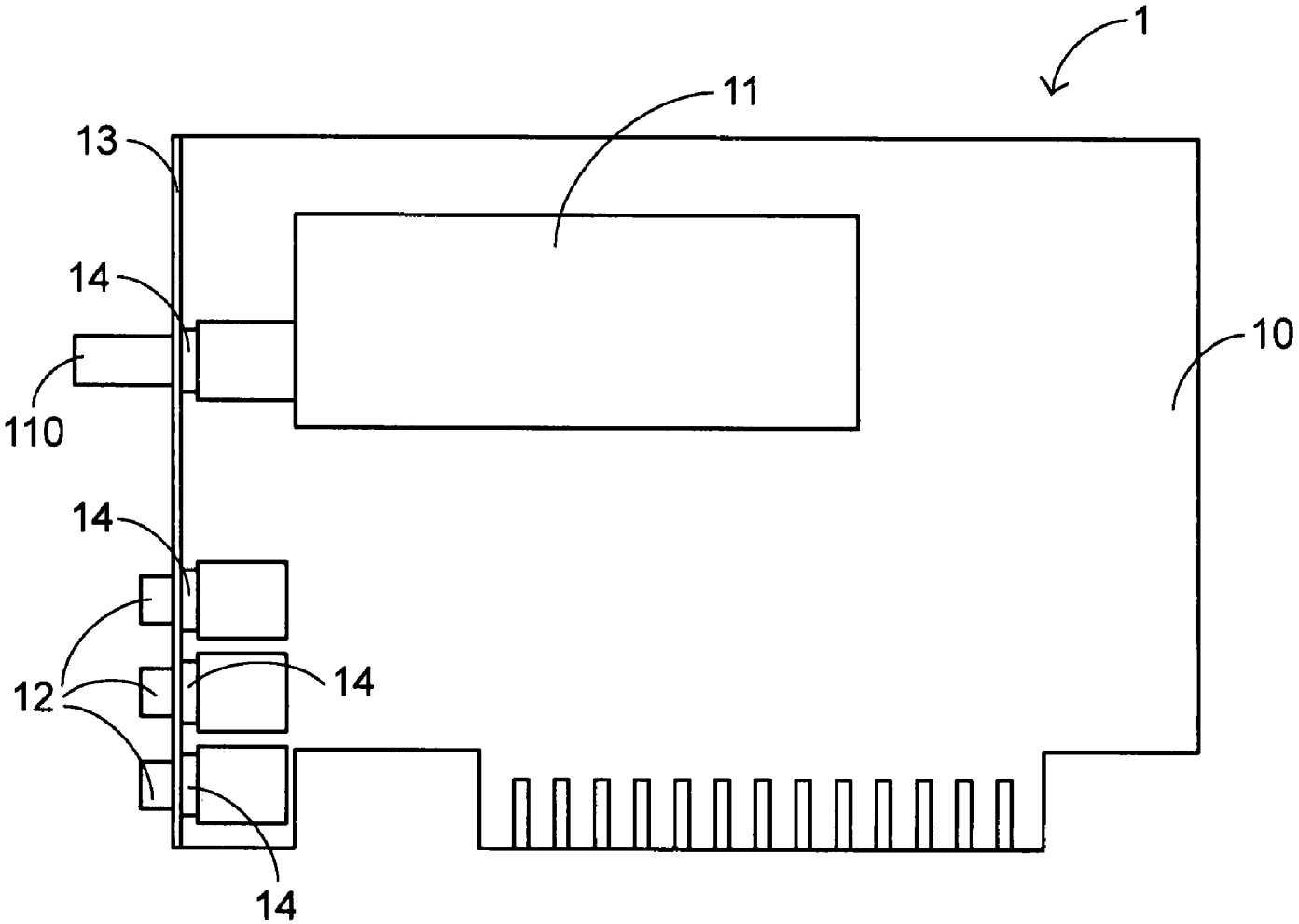
Fig.1 PRIOR ART
Figure 2A:
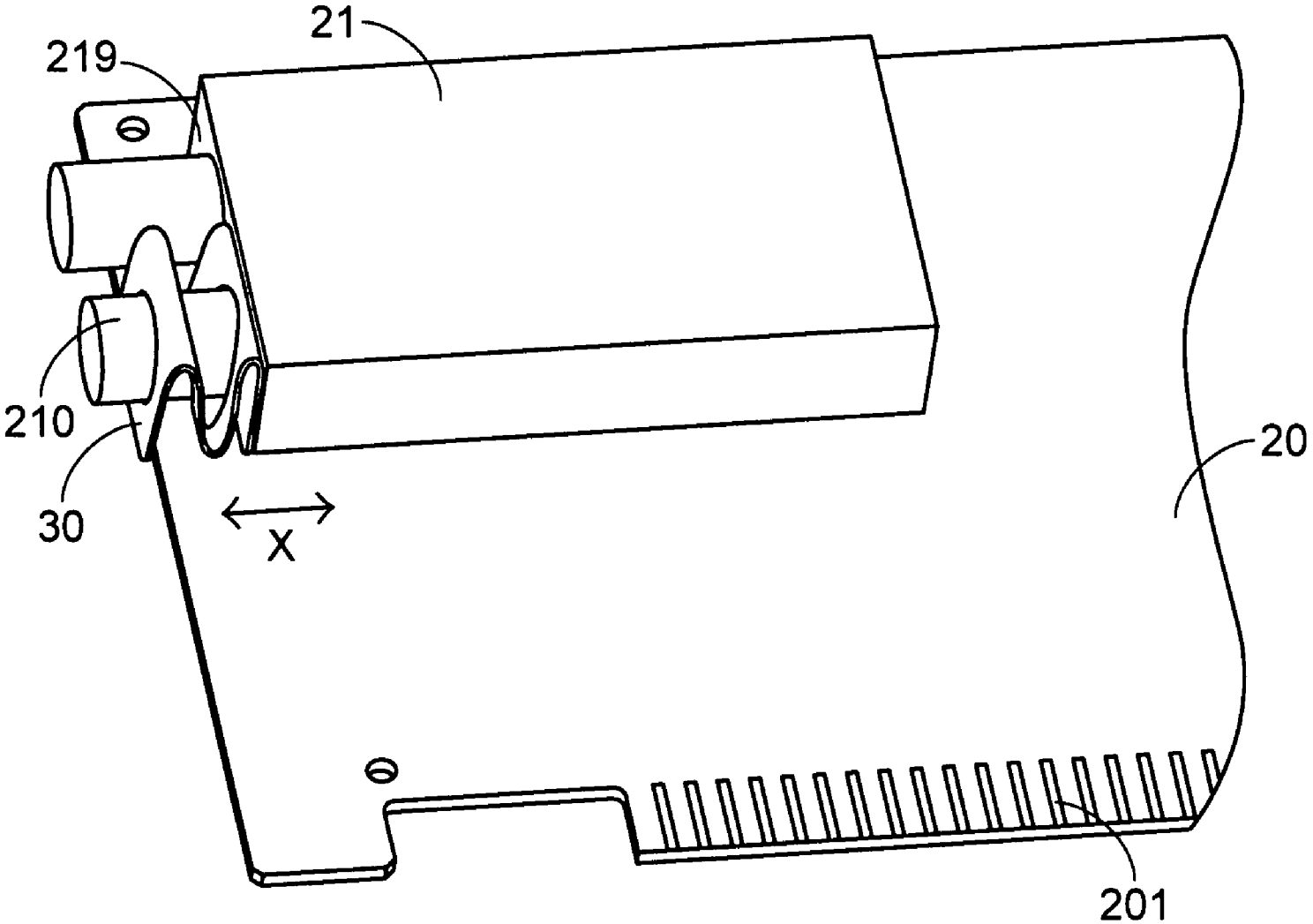
FIGS. 2(*a*), 2(*b*), 2(*c*) and 2(*d*) are schematic diagrams showing a TV card according to an embodiment of the present invention.
Figure 2B:
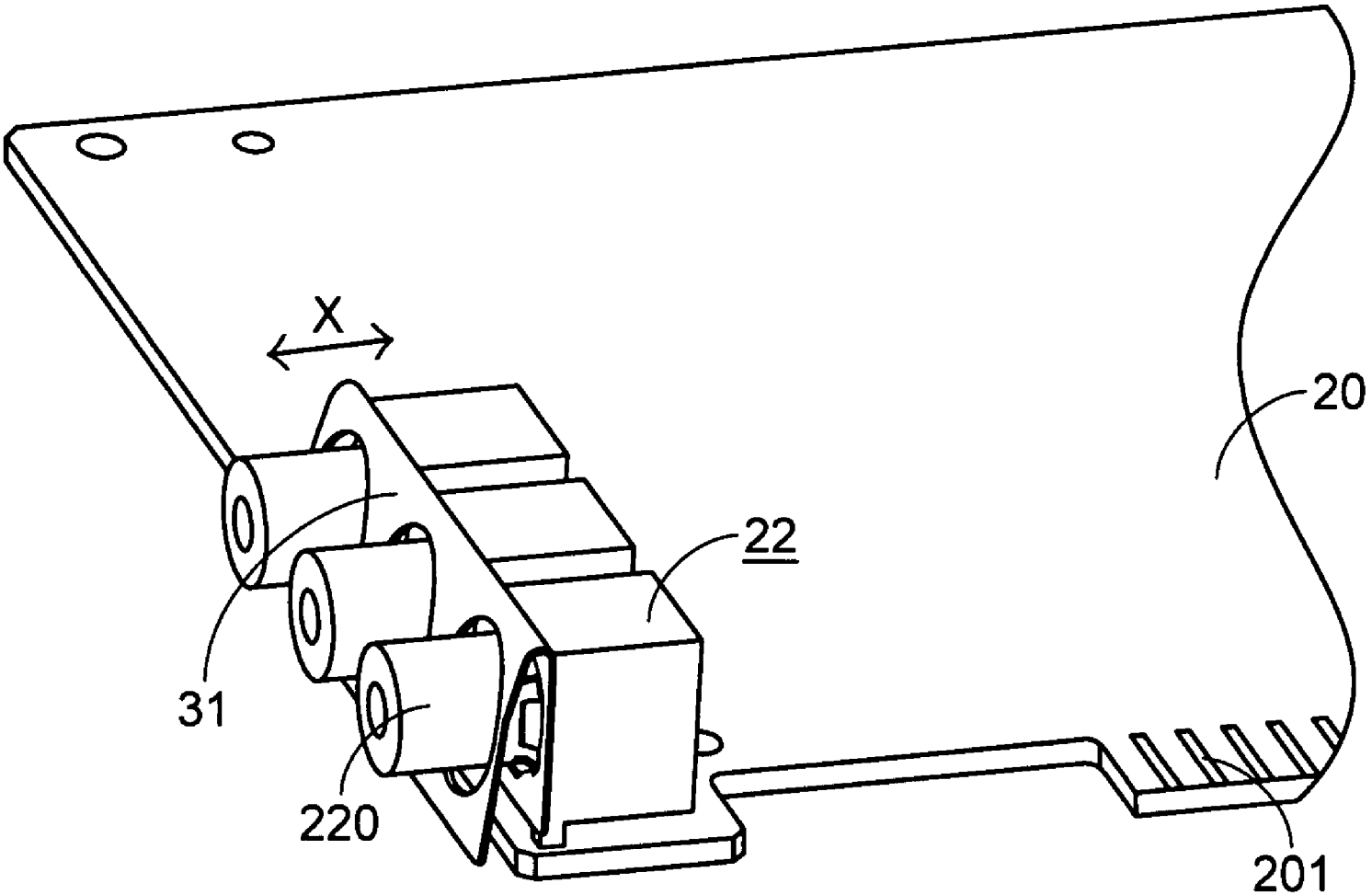
Figure 2C:
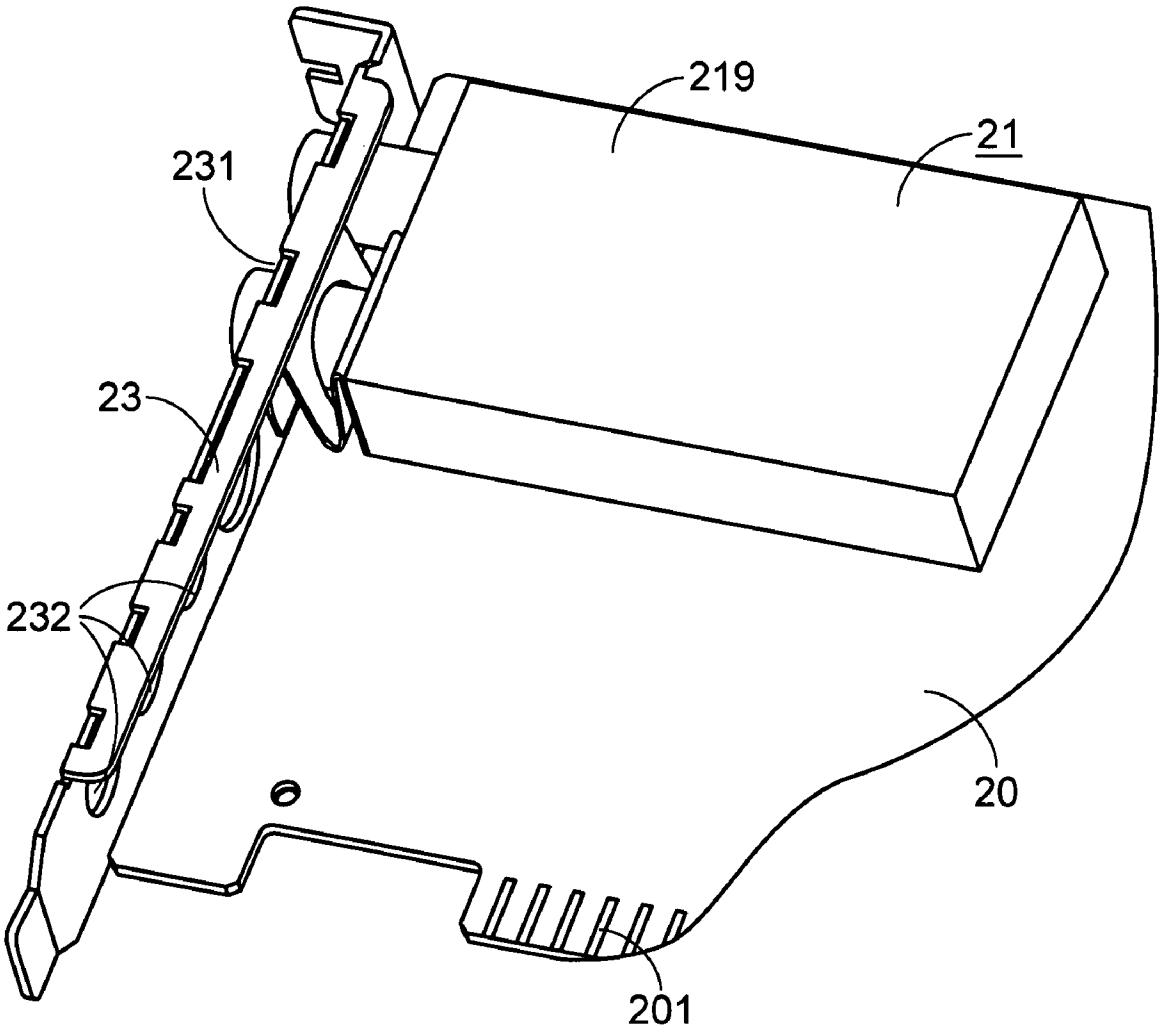
Figure 2D:
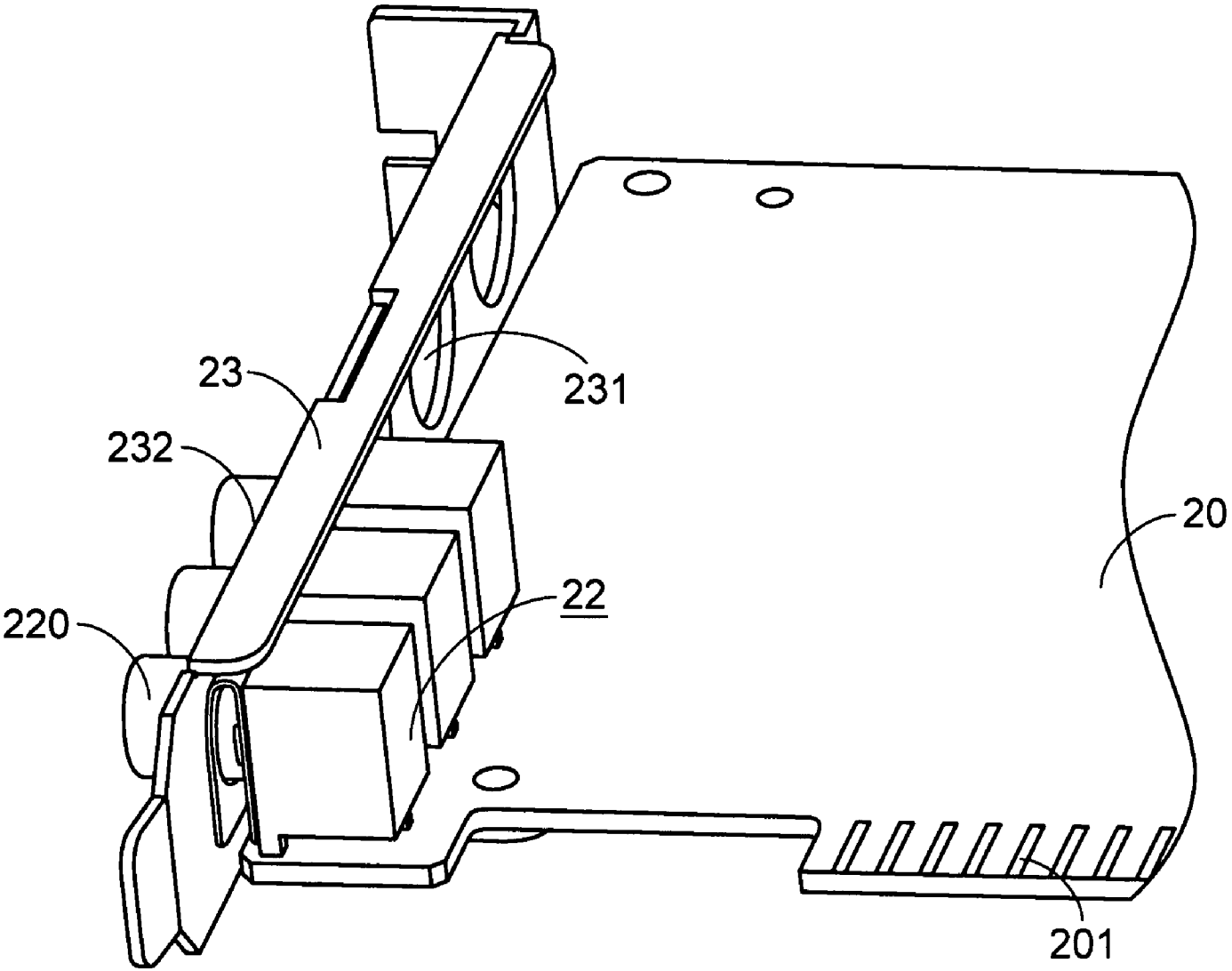

Please refer to FIGS. 2(*a*), 2(*b*), 2(*c*) and 2(*d*), which are schematic diagrams showing an adapter device according to an embodiment of the present invention. In this embodiment, a TV card is exemplified for describing the present invention. A TV signal transmission connector 210 disposed on a channel tuner 21 and an AV terminal socket set consisting of three AV terminal sockets 22 are exemplified to describe the invention. The TV signal transmission connector 210 is disposed on the channel tuner 21 and shares a metallic housing 219 with the channel tuner 21. The TV signal transmission connector 210 and the AV terminal socket set 22 are secured onto a circuit board 20 (as shown in FIGS. 2(*a*) and 2(*b*)), and the circuit board 20 has pins 201 to be inserted into an expansion slot (not shown) of the computer system. The TV signal transmission connector 210 and the AV terminal socket set 22 are available for the connection to external TV signal transmission connector (not shown) and AV signal transmission connector (not shown). The circuit board 20 is secured to the computer system via a securing plate 23 (as shown in FIGS. 2(*c*) and 2(*d*)) and screws (not shown) and the securing plate 23 has through holes 231 for exposing and partially protruding the TV signal transmission connector 210 and the AV terminal sockets 22. Moreover, elastic metallic conductive member 30 and 31 having crooked cross-sections in a direction X so as to be elastically stretchable in the direction X is provided. Accordingly, the elastic metallic conductive members, when mounted between the transmission connector 210/AV terminal socket set 22 and the securing plate 23, provide assembling allowance and tight sustaining force for the assembly, thereby accomplishing satisfactory conductivity, ESD protection and low noise interference.

As shown in FIGS. 2(*a*), 2(*c*) and 3(*a*), the metallic flexure strip 30 with an M-shaped cross section is used as the elastic metallic conductive member to accomplish the electric connection between the transmission connector 210 and the securing plate 23. There is an aligned through hole structure 301 provided for the penetration of the transmission connector 210 though the entire metallic flexure strip 30. After the transmission connector 210 penetrates through the through holes 301 and another through hole 231 of the securing plate 23, both sides of the metallic flexure strip 30 respectively sustain against and keep in contact with the securing plate 23 and the metallic housing 219, thereby accomplishing electric conduction, and successfully grounding the transmission connector 210.

Further referring to FIGS. 2(*b*), 2(*d*) and 3(*b*), the metallic flexure strip 31 with a U-shaped cross section is used as the elastic metallic conductive member to accomplish the electric connection between the AV terminal socket set 22 and the securing plate 23. There are three sets of aligned through holes 302 provided for the penetration of the AV terminal sockets 22. As the surrounding body of the AV terminal socket set 22 is basically formed of non-conductive material and the protruding terminals 220 are the only conductive parts, claw hooks 3020 are arranged in the through holes 302 of the metallic flexure strip 31 to be in contact and security with the terminals 220. After the AV terminal sockets 22 penetrate through the three sets of through holes 302 and another three through holes 232 of the securing plate 23, the other side of the metallic flexure strip 31 sustains against the securing plate 23 to accomplish the electric connection. Furthermore, via the metallic flexure strip 31, the three parts of the AV terminal socket independently mounted on the circuit board 20 are integrated so as to stabilize the disposition on the circuit board 20. Meanwhile, assembling allowance and tight sustaining force for the assembly can be achieved so as to accomplish satisfactory conductivity, ESD protection and low noise interference.

Figure 3C:
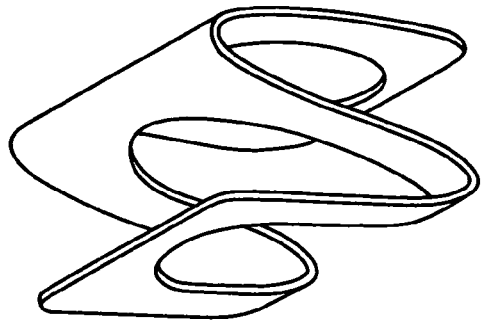
FIGS. 3(*a*), 3(*b*) and 3(*c*) are schematic diagrams showing three exemplified structures of a metallic flexure strip according to the present invention.
Figure 3B:
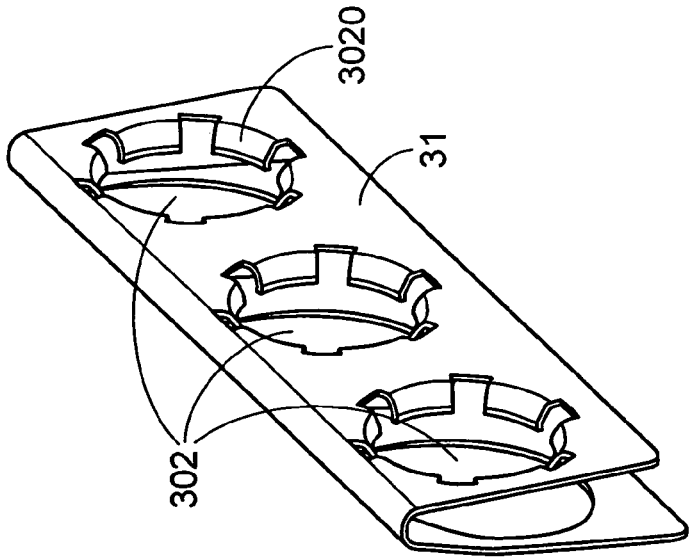
Figure 3A:
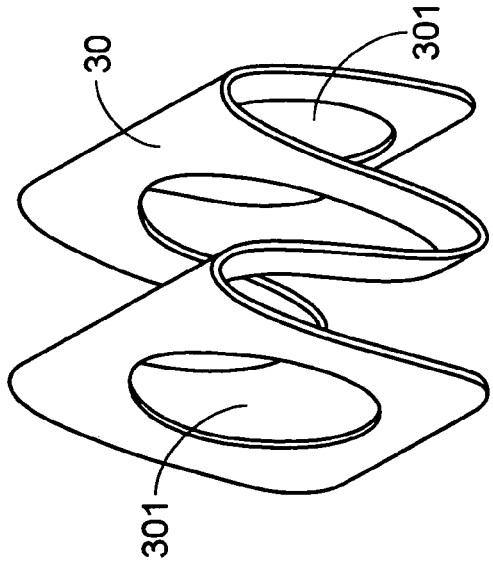

In view of the foregoing, by using an elastic securing device comprising above-mentioned securing plate and elastic metallic conductive member with a TV card and a computer system, the purposes of high assembling allowance, good conductive effect and additive value in appearance can be achieved at the same time. For example, the assembling of a TV card can be simplified by mounting the elastic metallic conductive member between the signal transmission connector socket and the securing plate, and then coupling the circuit board to the securing plate, thereby accomplishing the electric connection. In this manner, the laboring required for assembling can be reduced, the less reliable problem of conventional flexure rings can be overcome, and the manufacturing cost can be economized. Moreover, the elemental parts are simplified, the stock material is simple, the conductivity is reliable and the conductance is high. The metallic flexure strip mentioned above can be formed of Beryllium-Copper alloy plated with Nickel or Stainless Steel, and the crooked M-shaped or U-shaped cross section can also be replaced with crooked N-shaped cross section (FIG. 3(*c*)) or the like to achieve the objects of the present invention. In addition to TV cards, the present conception can be applied to other kinds of computer adapters. It is intended to cover various modifications and similar arrangements included within the spirit and scope of the appended claims which are to be accorded with the broadest interpretation so as to encompass all such modifications and similar structures.

What is claimed is:

1. An adapter for use in a computer system, comprising:

a circuit board to be inserted in an expansion slot of the computer system;

a signal transmission connector socket having a first end secured to said circuit board and a second end to be coupled to an external signal transmission connector;

a securing plate securable to the computer system and said circuit board, and having a through hole for exposing said second end of said signal transmission connector socket; and an elastic metallic conductive member mounted between said signal transmission connector socket and said securing plate, having a crooked cross-section extending in a certain direction, and having one end urging against a metallic housing of said signal transmission connector socket and an opposite end urging against said securing plate so as to be elastically deformable in said certain direction to accomplish electric connection between said signal transmission connector socket and said securing plate via said elastic metallic conductive member deforming in said certain direction.

2. The adapter according to claim 1 wherein said circuit board is disposed thereon pins to be inserted in the expansion slot of the computer system.

3. The adapter according to claim 1 wherein said signal transmission connector socket is a TV signal transmission connector that is disposed on a channel tuner and shares a metallic housing with said channel tuner.

4. The adapter according to claim 1 wherein said signal transmission connector socket is an AV terminal socket.

5. The adapter according to claim 1 wherein said elastic metallic conductive member is coupled to said signal transmission connector socket with claw hooks, while urging against said securing plate to accomplish electric connection between said signal transmission connector socket and said securing plate.

6. The adapter according to claim 5 further comprising another two signal transmission connector sockets, the elastic metallic conductive member including three through holes for receiving said signal transmission connector sockets, and said through holes having a claw-hook structure to couple to said signal transmission connector sockets.

7. The adapter according to claim 1 wherein said elastic metallic conductive member has a crooked cross section shaped "U", "N" or "M".

8. An elastic securing device for use with an adapter and a computer system, the adapter comprising a circuit board to be inserted in the computer system and an AV terminal socket coupled to the circuit board, and the elastic metallic conductive member comprising:

a securing plate to be coupled to the computer system and the circuit board, having a through hole for exposing the AV terminal; and an elastic metallic conductive member coupled to said AV terminal socket with claw hooks, mounted between the AV terminal socket and said securing plate, and having a crooked cross-section extending in a certain direction so as to be elastically deformable in said certain direction, thereby sustaining the AV terminal socket and said securing plate to accomplish electric connection between said AV terminal socket and said securing plate.

9. The elastic securing device according to claim 8 further comprising another two AV terminal sockets, said elastic metallic conductive member including three through holes for receiving the AV terminal sockets, each of which has a claw-hook structure to couple to the AV terminal sockets.

10. The elastic securing device according to claim 8 wherein said elastic metallic conductive member has a crooked cross section shaped "U", "N" or "M".

11. A method for assembling an adapter, comprising steps of:

providing a circuit board where an AV terminal socket is disposed;

providing a securing plate where a through hole is arranged for exposing the AV terminal socket; and coupling an elastic metallic conductive member to the AV terminal socket with claw hooks, mounting said elastic metallic conductive member between the AV terminal socket and the securing plate and then securing the circuit board to the securing plate, wherein the elastic metallic conductive member has a crooked cross-section extending in a certain direction so as to be elastically deformable in the certain direction, thereby sustaining the AV terminal socket and the securing plate to accomplish electric connection between the AV terminal socket and the securing plate.

* * * * *